United States Patent [19]

Kolbe

[11] 4,368,865

[45] Jan. 18, 1983

[54] DEVICE FOR SUSPENSION OF TENNIS RACKETS OR THE LIKE

[76] Inventor: Uwe Kolbe, Am Walde 3, D-2211 Oelixdorf, Fed. Rep. of Germany

[21] Appl. No.: 96,421

[22] Filed: Nov. 21, 1979

[51] Int. Cl.[3] ..... F16M 13/00

[52] U.S. Cl. ..... 248/214

[58] Field of Search ..... 248/214, 317, 318, 339, 248/340; 24/67.9, 67.11, 84 B, 84 H, 137 R, DIG. 9; 223/87, DIG. 1, DIG. 2

[56] References Cited

U.S. PATENT DOCUMENTS

| | | | |
|---|---|---|---|
| D. 191,824 | 11/1961 | Dollins | 24/DIG. 9 |
| 793,826 | 7/1905 | Damico | 24/67.11 |
| 1,295,480 | 2/1919 | Grant | 223/87 |
| 2,485,406 | 10/1949 | Paine | 248/259 |
| 3,123,331 | 3/1964 | Field et al. | 248/317 |
| 4,094,488 | 6/1978 | Bryant | 248/340 X |

FOREIGN PATENT DOCUMENTS

| | | | |
|---|---|---|---|
| 877903 | 9/1961 | United Kingdom | 24/67.9 |
| 1254496 | 11/1971 | United Kingdom | 248/317 |
| 2032512 | 5/1980 | United Kingdom | 248/317 |

*Primary Examiner*—William H. Schultz

*Attorney, Agent, or Firm*—Kontler, Grimes & Battersby

[57] ABSTRACT

A device for suspension of tennis rackets or the like has a flat, plate-like, elastically deformable body one end portion of which forms a hook so that it can be attached to a rod in a manner similar to that of attachment of clothes hangers to rods in closets or the like. The major portion of the body is formed with a U-shaped slot which surrounds a tongue-like inner section and is surrounded by a U-shaped outer section. The free end portion of the inner section carries a projection at each of its sides, and such projections can be inserted into or otherwise engaged by tennis rackets or other commodities which require suspension. Prior to suspension of a racket or the like, the inner section is flexed out of the plane of the outer section. The racket is then suspended on the projection which faces the outer section. Once the racket has been suspended, the inner section is released so that its natural tendency to assume the position of minimal deformation results in clamping of the suspended racket by and between the two sections. The outer section can be reinforced by one or more ribs which are provided on the body in the region of the upper end portion of the inner section. One projection of the inner section is a cylindrical stud, and the other projection of the inner section is an arcuate rib extending transversely of the inner section.

21 Claims, 3 Drawing Figures

Fig.1
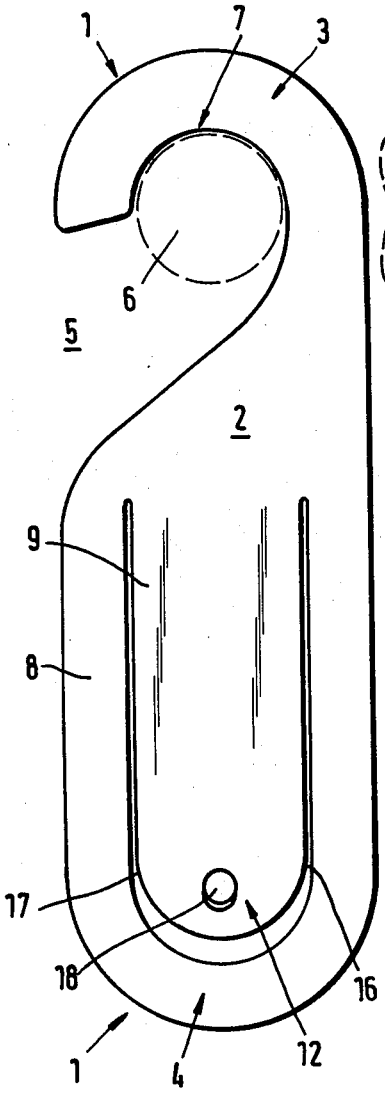
Fig.2
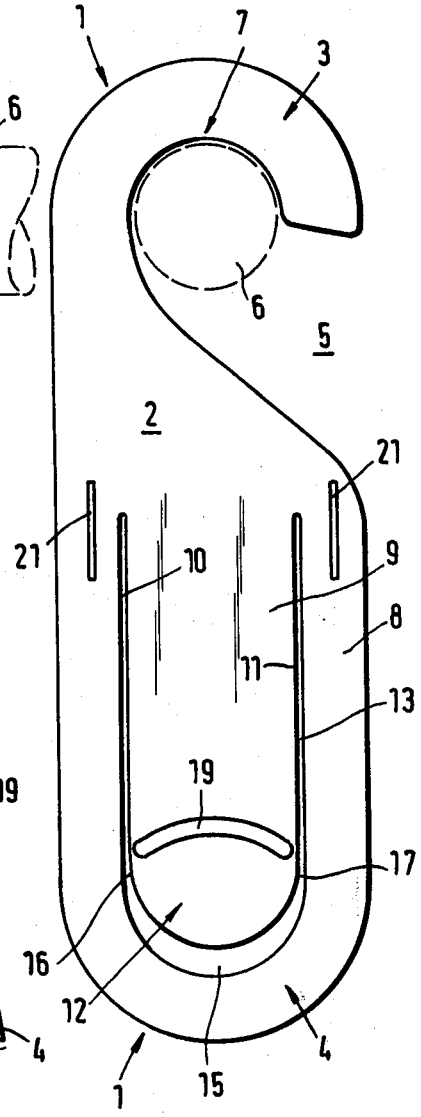
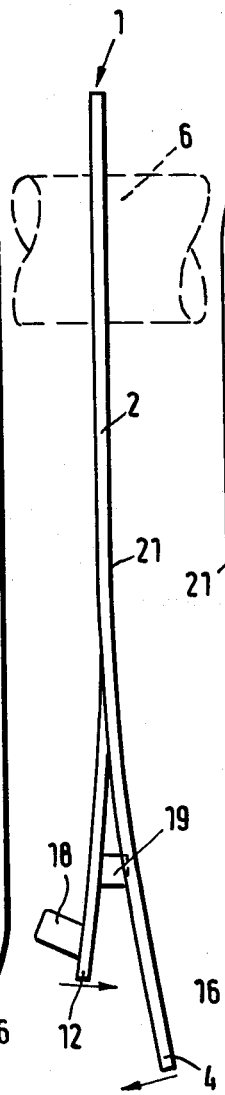
Fig.3

DEVICE FOR SUSPENSION OF TENNIS RACKETS OR THE LIKE

BACKGROUND OF THE INVENTION

The present invention relates to devices for suspending commodities in shops, clubhouses, schools, gymnasiums and other establishments, especially for suspending sports equipment, such as tennis rackets, badminton rackets, squash rackets and the like. More particularly, the invention relates to a device (hereinafter called hanger for short) which can be used with particular advantage for suspension of the afore-enumerated and/or other commodities in such a way that each commodity can be rapidly detached from or reattached to the hanger.

At the present time, various types of rackets, such as tennis rackets, badminton rackets, squash rackets and/or others, are normally stored in suspended condition or in the form of stacks. The devices for supporting rackets in suspended condition resemble meat hooks wherein one arcuate end portion serves to suspend the device on a rod and the other arcuate end portion serves for suspension of one or more rackets thereon. As a rule, the plane of the arcuate end portion for suspension of one or more rackets makes an angle of approximately 90 degrees with the plane of the other arcuate end portion. This renders it possible to store a plurality of rackets, one next to the other, by suspending the hooks on a rod or an analogous support.

A drawback of the just discussed conventional hangers which resemble meat hooks is that the rackets are likely to slip off the respective arcuate end portions. Moreover, a racket can be readily suspended on an arcuate end portion only if it is not confined in an envelope, such as a plastic casing which is normally employed for confinement of tennis rackets. Once the racket is inserted into a casing, it cannot be readily suspended on an arcuate end portion of a hook-shaped hanger. Therefore, the just described hangers cannot be used for suspension of rackets which are confined in casings, i.e., the casing must be removed prior to suspension of the unconfined racket on the hanger. This is undesirable and inconvenient for a number of reasons, i.e., the casing can be misplaced, the racket can be damaged and the casing requires additional storage space.

It is also known to resort to hangers in the form of simple clamps which are used for suspension of commodities made of a textile material, e.g., for suspension of dusting cloths or the like. Basically, such hangers consist of two legs which can be displaced relative to each other so that a portion of a cloth can be inserted therebetween while at least one of the legs is held in deformed condition. The deformed leg is thereupon released so that it pinches the inserted portion of the cloth against the other leg. Presently known hangers of the just outlined character are only capable of supporting lightweight commodities, such as the aforementioned dust cloths or the like. Moreover, in most instances, the pinching action of such hangers is satisfactory only if the articles or commodities to be suspended are readily deformable, i.e., the hangers can be used for suspension of commodities consisting of textile material, readily deformable synthetic plastic sheet material, netting or the like.

OBJECTS AND SUMMARY OF THE INVENTION

An object of the invention is to provide a simple, inexpensive and versatile hanger for suspension of a wide variety of commodities regardless of whether the commodities are rigid, flexible or partly rigid and partly flexible.

Another object of the invention is to provide a hanger which can be used for temporary or longer-lasting suspension of lightweight or relatively heavy commodities and which can be readily manipulated by unskilled persons without any demonstration, training or perusal of written instructions.

A further object of the invention is to provide a hanger which can be used for convenient suspension of all or nearly all forms of rackets or other types of sports equipment irrespective of whether such equipment is or is not stored in casings or other types of envelopes.

An additional object of the invention is to provide a hanger which can be supported by a simple rod, either alone or together with one or more additional hangers so as to insure that the suspended commodities are stored in eye-pleasing formation.

Another object of the invention is to provide a hanger whose manufacturing cost is low, which occupies a minimum of space when not in use, and which can remain attached to the commodities during transport, e.g., during transport of tennis rackets or other sports equipment in a vehicle from a clubhouse or private home to the court or vice versa.

A further object of the invention is to provide a hanger which can be furnished in many different sizes, shapes and/or colors, either for the sole purpose of enhancing its appearance or for the purpose of enhancing its strength, versatility and/or utility in connection with the suspension of a given type of commodity.

One feature of the invention resides in the provision of a hanger for tennis rackets or like commodities (this latter term is intended to embrace all types of articles which can or should be suspended for temporary or longer-lasting storage on racks, in closets, in lockers or in or on like depositories). The hanger comprises a substantially plate-like body including a preferably tongue-like inner section and an outer section (e.g., a U-shaped outer section) which at least partly surrounds the inner section. At least one of the sections (preferably the inner section) is elastically deformable, and at least one of the sections (preferably the inner section) has at least one projection (e.g., a substantially cylindrical stud or an arcuate rib) for suspension of commodities thereon in such positions that the natural tendency of the deformable section to assume a position of minimal deformation results in the clamping or pinching of a suspended commodity by and between the sections. If the deformable section is the inner section and at least one side of the inner section carries at least one projection, such inner section can be flexed to the one or the other side of the general plane of the other (outer) section prior to suspension of a commodity on the projection which faces the plane of the outer section. The deforming stress upon the inner section is thereupon relaxed or terminated so that the inner section tends to return into or toward the plane of the outer section with the result that the commodity which is suspended on the projection is clamped between one side of the inner section and one side of the outer section. Consequently, the weight of the suspended commodity or commodities is or can be carried exclusively by the projection or projections whereas the sections of the plate-like body merely hold the suspended commodity or commodities against slippage off the projection or projections.

One end portion of the plate-like body (preferably that end portion which is remote from the projection or projections) preferably resembles a hook so that it can be readily suspended on a rod which forms part of a rack or which is installed in a closet, in a locker or in a similar depository for new (unused) or used commodities. For example, the hanger can be used for suspension of rackets in a sports equipment store so that the rackets are suspended one next to the other (with or without casings) or in a gymnasium or clubhouse. The commodities which are suspended on the improved hanger or hangers may but need not be identical, i.e., different types of rackets or other sports equipment can be suspended next to each other, either in a store or in a clubhouse. A customer or an owner can readily detach a racket from or reattach the racket to the hanger. Each hanger can support a single commodity or two or more commodities, depending on its size, the length of its projection or projections, the weight of the commodities to be suspended, the bulk of such commodities, the amount of space which is available for suspension of the hanger and/or commodities thereon, and/or other factors.

The novel features which are considered as characteristic of the invention are set forth in particular in the appended claims. The improved hanger itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a side elevational view of a hanger which embodies the invention, the veiw being taken from the left-hand side of FIG. 3;

FIG. 2 is a similar side elevational view of the improved hanger but taken from the right-hand side of FIG. 3; and FIG. 3 is an end elevational view of the hanger which is shown in FIGS. 1 and 2.

DESCRIPTION OF THE PREFERRED EMBODIMENTS

The hanger which is shown in FIGS. 1 to 3 comprises a substantially plate-like elongated body 2 which preferably consists of suitable elastomeric synthetic plastic material. The elasticity of the material of the body 2 need not be very pronounced, i.e., it suffices (at least in certain instances) if the material of the body 2 can be deformed in response to the exertion of a rather substantial force. It goes without saying that the body 2 can also be made of a metallic material, e.g., of spring steel or the like. Both end portions 1 of the elongated body 2 are rounded and one end portion constitutes a hook 3 which has a socket 7 for convenient suspension of the hanger on a rod 6. The lateral opening or slot 5 of the body 2 is large enough to allow for convenient attachment of the hook 3 or for detachment of such hook from the rod 6. As explained hereinbefore, the rod 6 can form part of a display rack in a store or it may be installed in a closet, in a locker or in another depository for temporary storage of rackets or other types of sports equipment. Furthermore, it is to be noted that tennis equipment constitutes but one form of commodity which can be stored temporarily or for longer intervals of time by resorting to the improved hanger.

The lower portion 4 of the body 2 comprises two sections including an elongated inner section or tongue 9 and an elongated U-shaped outer section or frame 8 which, in the illustrated embodiment, completely surrounds the inner section 9. The outer section 8 has two parallel legs which flank the section 9 and an arcuate yoke which constitutes the lower end portion 1 of the hanger. The legs and the yoke of the section 8 are separated from the inner section 9 by an arcuate slot having two elongated parallel portions 10, 11 which flank the parallel edge faces 13 of the section 9 and are of constant width, and two portions 16, 17 whose width increases toward the apex 15 of the rounded free lower end portion 12 of the inner section 9. The upper end portion of the section 9 is integral with the section 8, i.e., with the upper end portions of the two parallel legs of the outer section 8. The width of the inner section 9 (as measured horizontally in FIG. 1 or 2) is preferably a multiple of (e.g., at least three times) the width of the one or the other leg of the outer section 8. For the sake of simplicity, the width of the outer section 8 will be assumed to correspond to the width of the one or the other leg or to the width of the arcuate lower end portion of this section. The width of the slot between the sections 8 and 9 reaches its maximum value at the apex 15 (lowermost point) of the rounded end portion 12.

The inner section 9 is provided with two projections 18 and 19. The projection 18 is a cylindrical stud whose axis makes an acute angle with the general plane of the section 9. When the section 9 is deformed so that its end portion 12 is moved out of the general plane of the section 8, a racket (not shown) can be suspended on the projection 18, and the axis of such projection is then normal or can be normal to the general plane of the section 8 (it being assumed that the section 8 is not deformed at all). The projection 18 extends from one side and the projection 19 extends from the other side of the end portion 12. The projection 19 is an arcuate rib having a length which equals or approximates the (constant) width of the section 9. As shown, the rib 19 extends substantially transversely of the section 9, and its convex upper side faces away from the apex 15 of the end portion 12. The curvature of the surface bounding the end portion 12 is more pronounced than the curvature of the upper side of the rib 19. This rib, too, can support a portion of the frame of a racket or the like. As shown in FIG. 3, the section 9 can be flexed to either side of the section 8. FIG. 3 further shows that the sections 8 and 9 can be flexed simultaneously, either to the same extent or to different extents. This depends on the user and on the accessibility of the section 8 and/or 9 while the hook-shaped upper end portion 3 of the body 2 is suspended on a support such as the rod 6. The inclination of the rib 19 with respect to the corresponding side of the section 9 can also be selected in such a way that this rib is substantially normal to the plane of the section 8 when the section 9 is moved from the general plane of the section 8 and/or vice versa. It is equally within the purview of the invention to provide the section 9 with two stud-shaped projections, with two rib-shaped projections or with more than two projections, e.g., with several projections at one side and with one projection at the other side of the end portion 12. The configuration and/or the number and size of the projections depends on the intended use of the hanger. The illustrated projection or rib 19 has a constant width (as measured in the longitudinal direction of the section 9) and a constant height (as measured substantially at right angles to the plane of the section 9). As shown in FIGS. 1 and 3, the axis of the stud-shaped projection 18 and the plane of the section 9 make an oblique angle, i.e., an angle other than 90 degrees.

The improved hanger further comprises means for reinforcing selected portions of its body, preferably one or more portions of the outer section 8. The drawing shows two reinforcing ribs 21 which are elongated and parallel to each other as well as to the inner section 9 and the two legs of the outer section 8. These ribs are provided on the upper end portions of the legs of the outer section 8, i.e., in the regions where the upper end portion of the section 9 is integral with the section 8. The body 2 can be provided with reinforcing means at one side (as shown in the drawing) or at both sides thereof. The dimensions, positioning and/or distribution of the reinforcing ribs will depend on the selected material of the body 2, on the intended use of the hanger, and on certain other factors. If desired, the reinforcing ribs 21 can extend along the full length of the two legs of the outer section 8. Furthermore, one or more reinforcing ribs can be provided at the one and/or the other side of the inner section 9. Still further, reinforcing means can be embedded in the material of the body 2 so that the reinforcement(s) cannot be seen from without.

If a user wishes to suspend an article (e.g., a racket with or without a casing) on the improved hanger and desires to use the arcuate rib-shaped projection 19, the inner section 9 is flexed to and beyond the position of FIG. 3 so that a portion of the frame of the racket can be suspended by placing its concave side over the convex upper side of the projection 19. This necessitates a deformation of the section 9 and/or section 8 beyond the position shown in FIG. 3. When the racket is properly suspended on the projection 19, the deforming stress upon the section 8 and/or 9 is relaxed or terminated so that these sections tend to reassume the positions of minimal deformation whereby the section 9 moves toward the plane of the section 8 and/or vice versa. The frame of the racket is then automatically clamped between the sections 8 and 9 and remains suspended on the projection 19 until the sections 8 and 9 are forcibly moved apart so as to allow for separation of the racket from the projection 19. The projection 19 is especially suited for retention of rackets which are confined in casings, and the stud-shaped projection 18 is especially suited for suspension of rackets which are not confined in casings or other types of envelopes. It has been found that relatively small and weak projections on the end portion 12 of the inner section 9 can carry relatively heavy commodities. Also, each projection can support two or more commodities, depending on the length of the projection and/or on the dimensions of the commodities.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. A hanger for tennis rackets or like commodities, comprising a plate-like body having a hook-shaped end portion for suspending the same, said body further including a deformable inner section, and an outer section which substantially entirely surrounds said inner section and has two elongated legs flanking said inner section, said outer section comprising reinforcing means for enhancing the rigidity thereof, and said reinforcing means being provided on and extending lengthwise of at least one of said legs, one of said sections but not the other having at least one projection adapted to engage and suspend a commodity, and said one projection having a free end, said sections being resiliently movable relative to one another between a first position in which said free end is located intermediate said sections so as to permit suspension of a commodity from said projection and a second position in which said sections cooperate to clamp the commodity.

2. The hanger of claim 1, wherein said body consists essentially of elastomeric material and said one projection is provided on said inner section.

3. The hanger of claim 1, wherein both of said sections are elongated and said inner section has a width which exceeds the width of said legs.

4. The hanger of claim 3, wherein the width of said inner section is a multiple of the width of said legs.

5. The hanger of claim 1, wherein both of said sections are elongated and define a slot having two portions of substantially constant width flanking said inner section and being flanked by said outer section.

6. The hanger of claim 1, wherein said inner section is elongated and includes a first end portion integral with said outer section and a rounded second end portion having an apex, said sections defining a substantially U-shaped slot having an arcuate portion which surrounds said second end portion and whose width increases in a direction toward said apex.

7. The hanger of claim 1, wherein said one projection is a rib.

8. The hanger of claim 7, wherein said inner section is elongated and said rib is provided on said inner section, the length of said rib approximating or matching the width of said inner section.

9. The hanger of claim 8, wherein said rib extends substantially transversely of said inner section.

10. The hanger of claim 1, wherein said inner section has a free end portion remote from said hook-shaped end portion and said one projection is provided on said inner section in the region of said free end portion thereof.

11. The hanger of claim 1, wherein said one projection is a substantially cylindrical stud and the axis of said stud makes an oblique angle with the plane of said body in the undeformed condition of said body.

12. A hanger for tennis rackets or like commodities, comprising a plate-like body having a hook-shaped end portion for suspending the same, said body further including a deformable inner section, and an outer section which substantially entirely surrounds said inner section and comprises two legs flanking said inner section and having end portions integral with the same, said outer section including reinforcing means for enhancing the rigidity thereof, and said reinforcing means being provided on at least one of said legs in the region of the end portion thereof, one of said sections but not the other having at least one projection adapted to engage and suspend a commodity, and said one projection having a free end, said sections being resiliently movable relative to one another between a first position in which said free end is located intermediate said sections so as to permit suspension of a commodity from said projection and a second position in which said sections cooperate to clamp the commodity.

13. A hanger for tennis rackets or like commodities, comprising a plate-like body having a hook-shaped end portion for suspending the same, said body further including an inner section having a pair of sides, and an outer section which substantially entirely surrounds said inner section, said inner section but not said outer section having at least one projection adapted to engage and suspend a commodity, and said one projection being provided at one of said sides and having a free end, said sections being resiliently movable relative to one another between a first position in which said free end is located intermediate said sections so as to permit suspension of a commodity from said one projection and a second position in which said sections cooperate to clamp the commodity, and said inner section having an additional projection at the other of said sides thereof.

14. The hanger of claim 13, wherein at least one of said sections is elongated and has a substantially constant width.

15. The hanger of claim 13, wherein said inner section is deformable and said outer section includes reinforcing means for enhancing the rigidity thereof.

16. The hanger of claim 15, wherein said outer section has two legs flanking said inner section and said reinforcing means is provided on at least one leg of said outer section.

17. The hanger of claim 13, wherein each of said projections makes an oblique angle with the plane of said inner section.

18. The hanger of claim 13, wherein said inner section is deformable and movable to and from the plane of said outer section, said one projection being provided on said inner section and being inclined with respect to the plane of said inner section in such a way that it is substantially normal to the plane of said outer section when said inner section is moved out of the plane of said outer section.

19. The hanger of claim 13, wherein said one projection is a substantially cylindrical stud.

20. A hanger for tennis rackets or like commodities, comprising a plate-like body having a hook-shaped end portion for suspending the same, said body further including an inner section having a rounded free end portion, and an outer section which substantially entirely surrounds said inner section, said inner section but not said outer section having at least one projection adapted to engage and suspend a commodity, and said projection being an arcuate rib in the region of said free end portion having a curvature different from that of the latter, said projection having a free end, and said sections being resiliently movable relative to one another between a first position in which said free end is located intermediate said sections so as to permit suspension of a commodity from said projection and a second position in which said sections cooperate to clamp the commodity.

21. The hanger of claim 20, wherein said rib has a convex side facing away from said free end portion.

* * * * *